US008267330B2

(12) United States Patent
Huang

(10) Patent No.: US 8,267,330 B2
(45) Date of Patent: Sep. 18, 2012

(54) MOBILE HOSE WINDING APPARATUS

(75) Inventor: Jian Huang, Yongkang (CN)

(73) Assignee: Ames True Temper, Inc., Camp Hill, PA (US)

( * ) Notice: Subject to any disclaimer, the term of this patent is extended or adjusted under 35 U.S.C. 154(b) by 263 days.

(21) Appl. No.: 12/732,269

(22) Filed: Mar. 26, 2010

(65) Prior Publication Data

US 2011/0036924 A1 Feb. 17, 2011

(51) Int. Cl.
*B65H 75/48* (2006.01)
*B65H 75/34* (2006.01)
*B65H 75/00* (2006.01)

(52) U.S. Cl. ..... 239/198; 239/197; 239/447; 242/375; 242/385; 242/385.4; 137/355.2; 137/355.23

(58) Field of Classification Search ..... 239/195, 239/197, 198, 444, 447–449, 525, 526, 530; 137/355.16, 355.2, 355.23; 242/371, 375, 242/375.2, 375.3, 376, 379, 385, 385.4, 398
See application file for complete search history.

(56) References Cited

U.S. PATENT DOCUMENTS

| | | | | | |
|---|---|---|---|---|---|
| 2,683,056 | A * | 7/1954 | Hilfinger | 239/748 |
| 4,543,982 | A * | 10/1985 | Wolfe | 137/355.21 |
| 4,582,257 | A * | 4/1986 | Siegler | 239/197 |
| 5,390,695 | A * | 2/1995 | Howard | 137/355.27 |
| 5,392,808 | A * | 2/1995 | Pierce | 137/355.23 |
| 5,782,412 | A * | 7/1998 | Plantz et al. | 239/197 |
| 7,073,529 | B1 * | 7/2006 | Harkey | 137/355.23 |
| 2003/0173417 | A1 * | 9/2003 | Lu | 239/197 |
| 2005/0103885 | A1 * | 5/2005 | Nies | 239/198 |

* cited by examiner

*Primary Examiner* — Darren W Gorman
(74) *Attorney, Agent, or Firm* — Eckert Seamans Cherin & Mellott, LLC; David C. Jenkins

(57) ABSTRACT

A mobile hose winding apparatus, including a case, a hose winding mechanism for hose winding, a sprinkler mechanism and a water inlet and outlet mechanism. One end of the water inlet and outlet mechanism is used to connect to the hose on the winding mechanism while the other end is connected to the water inlet of the sprinkler mechanism; the hose winding mechanism and the water inlet and outlet mechanism are fitted in the case, with the sprinkler mechanism in the front of the case. The mobile hose winding apparatus abandons the wall-mounted connecting mode of the conventional hose winding apparatus, and thus the apparatus according to the present disclosure can be moved as a whole for operation.

6 Claims, 8 Drawing Sheets

MOBILE HOSE WINDING APPARATUS

CROSS REFERENCE TO RELATED APPLICATION

This application claims priority under 35 U.S.C. §119(e) to Chinese Provisional Patent Application Serial No. 200920207875.3, filed Aug. 14, 2009, entitled, MOBILE HOSE WINDING APPARATUS.

FIELD OF THE INVENTION

The present invention relates to a hose winding apparatus for hose collecting, especially a mobile hose winding apparatus which can conduct local watering in a comparatively narrow space (such as a balcony) or a space without wall but with a water outlet.

BACKGROUND OF THE INVENTION

The wall-hung hose winding apparatus is usually adopted as the hose winding apparatus for collecting hose at present. The wall-hung hose winding apparatus is limited, for the rotating range is restricted in operation. It can only rotate by 180°, so the operation efficiency, when hose is used, is low. Additionally, it has to be hung on the wall, so the fixing position is greatly affected by outside factors (it cannot be used in the places where there is no wall or other fixing parts). Even after hung on the wall and fixed, it is not convenient for removal. In that case, more space is occupied and artistic effect is affected. It takes time and efforts to hang and fix it on the wall.

The sprinkler of the current hose winding apparatus for hose collecting is connected to the water outlet of the hose. The independent operation is required. Meanwhile, the spray of the nozzle is greater, with greater pressure of water spray. When watering flowers and plants in a short distance, it is easy to hurt the flowers and plants.

Previous nozzles are not equipped with a trigger mechanism (water inlet and outlet control mechanism) or when there is a trigger mechanism, there are only two states of the mechanism. One state is that the trigger mechanism (water inlet and outlet control mechanism) is not used, and the other is that the trigger mechanism (water inlet and outlet control mechanism) is completely turned on. Therefore, it is not very convenient when using.

The locking device of the current hose winding apparatus for hose collecting is a ratchet locking device. It is not convenient to use the ratchet locking device of the current hose winding apparatus. In operation, one can only lock the hose periodically but cannot lock the hose at any position. The locking operation technique is difficult for mastering. The other is a random locking device, which can lock at any position in operation. However, complicated structure and high cost are also the main headache.

The kettle usually for flower watering can only do watering after filled with water. When the water is used, up, it has to be refilled with water. Therefore, it is not very convenient for operation.

SUMMARY OF THE INVENTION

The purpose of the present disclosure is to provide a mobile hose winding apparatus, which can move as a whole for operation.

In order to achieve the above purpose, the mobile hose winding apparatus of the present disclosure comprises a case, a hose winding mechanism for hose winding, a sprinkler mechanism, and a water inlet and outlet mechanism, with one end connected to a hose on the hose winding mechanism and the other end connected to the water inlet of the sprinkler mechanism, wherein, the hose winding mechanism and the water inlet and outlet mechanism are fitted in the case, the sprinkler mechanism is fitted in the front of the case.

After the hose is pulled out from the mobile hose winding apparatus, the hose will be supplied with water supply. Then the whole mobile hose winding apparatus can move around for watering in a narrow or limited space or in the places where there is no wall, such as in gardens, parks or open lots. The wall-hung connecting mode of the conventional hose winding apparatus is not adopted in the hose winding apparatus of this new model. The integral moving of the whole apparatus is adopted for operation. Its rotating range is larger, and its operation is not limited by space. So it can be used within the reach of the hose. The sprinkler of the apparatus is fitted in the front of the case and integrated with the apparatus. So no independent operation is required. The watering kettle usually requires refilling at water supply for continuing operation. If the new model is adopted, water will be directly sprayed out from the sprinkler mechanism, saving time and efforts while improving efficiency and convenience.

In one preferred embodiment, the mobile hose winding apparatus also comprises a hose arrangement mechanism fitted in the case. Such mechanism is cooperated with the hose winding mechanism. When the hose is recoiled back into the hose winding apparatus, the arrangement mechanism will make the hose arranged in a good order in the hose winding mechanism.

In one preferred embodiment, the hose winding mechanism comprises a main axle of a winding wheel fixed on the case, a winding spring and the winding wheel which is rotatably fitted on the main axle, one end of the winding spring is fixed on the winding wheel, and the other end of the winding spring is fixed on the main axle of the winding wheel; the winding spring provides resilience to automatically recoil back the hose that is pulled out.

In one preferred embodiment, the mobile hose winding apparatus also comprises a water inlet and outlet control mechanism for controlling the flow rate of the water inlet and outlet mechanism, the water inlet and water outlet control mechanism being fitted in the case.

In one preferred embodiment, a manual locking mechanism is fitted between the case and one side of the hose winding mechanism adjacent to the case, the manual locking mechanism comprising the manual locking knob locking block and locking spring; the manual locking knob is fitted on the external side of the case and can rotate around the axis thereof; the locking block and the manual locking knob are fixedly connect with each other, the locking spring is a torsion spring, with one end of the spring connected to the locking block and the other end to the case, a toothed locking plate is fitted on the side of the winding mechanism, with teeth uniformly distributed along a circumference on the toothed locking plate; a pointed end of the locking block can mesh with the saw-teeth of the toothed locking plate to form an one-way locking device; when the locking knob is in a turned-on state, the pointed end of the locking block is far away from the toothed locking plate, and thus the hose can be freely pulled out from and recoil back into the hose winding mechanism; when the manual locking button is in the locking position, under the force of the locking spring, the pointed end of the locking block is engaged with the saw-teeth of the toothed locking plate, at this time, a hose winding wheel of the hose winding mechanism is only able to rotate in one direction, so the hose is locked, and the hose can be pulled out but cannot recoil.

In one preferred embodiment, the water inlet and outlet mechanism comprises a water inlet connecting part and a water outlet connecting part, a water outlet is fitted in the main axle of the winding wheel along axial direction thereof and connected with the water outlet connecting part; the water inlet connecting part is sleeved on the main axle of the winding wheel; a water inlet is provided in one side of the water inlet connecting part, the water inlet is used to fixedly connect the hose winded on the winding wheel; a water inlet of the main axle of the winding wheel is communicated with the water inlet of the water inlet connecting part, the connection between the main axle of the winding wheel and the water inlet connecting part is sealed with the sealing element or elements; the water inlet connecting part can rotate freely around the main axle of the winding wheel but cannot move in the axial direction; the connection between the water outlet connecting part and the main axle of the winding wheel is sealed with the sealing element, and the water outlet of the water outlet connecting part is used to communicated with the sprinkler mechanism.

In one preferred embodiment, the mobile hose winding apparatus also comprises a water inlet and outlet control mechanism for controlling the flow rate, which is configured in the case. The water inlet and water outlet mechanism and the sprinkler mechanism are connected with each other via sprinkler water inlet connecting parts or part; the water inlet and water outlet control mechanism comprises a switch, a button, an actuator and a water stop valve; the water stop valve is located in the central hole of the sprinkler water inlet connecting part for regulating the flow rate between the water inlet and water outlet mechanism ad the sprinkler mechanism; the actuator is fitted between the button and the water stop valve for transmitting the motion of button to the water stop valve; when the switch is in turned-on state, the button can operate freely and move the water stop valve in the central hole of the sprinkler water inlet connecting part via the actuator to control the flow rate between water inlet and water outlet mechanism and the sprinkler mechanism; when the switch is in turned-off state, the button is locked by the switch.

In one preferred embodiment, the actuator of the water inlet and water outlet control mechanism comprises a push block; the switch can rotate around a pivot fixed on the case; the switch has saw-teeth; the button can rotate around a pivot fixed on the case; the button has saw-teeth corresponding to the teeth on the switch, with the saw-teeth distributed along a section of circular arc with the pivot of the button as the center of circle, one side of the button close to the head of the push block is configured with an inclined surface, the side of the sprinkler water inlet connecting part is configured with a columnar boss for the push block to insert into, with a spring fitted between the columnar boss and the push block; a washer is also fitted in the central hole of the sprinkler water inlet connecting part; the end of the push block close to the water stop valve is configured with an inclined surface, and the water stop valve is configured with an opening, The side of the water stop valve with opening is configured with an inclined surface cooperated with the inclined surface of the push block; the side of water stop valve close to the washer is configured with a circular conic convex surface, and the washer has a circular conic concave surface cooperated with the circular conic convex surface of the water stop valve; when the switch is in the turned-on state, the teeth of the switch are located outside the circular arc of button, and the button can rotate freely around the pivot thereof; when the button is pushed, the inclined surface of the button contacts the push block and pushes the head of the push block, and the push block overcomes the elastic force of the spring and moves in the spring compression direction, then the inclined surface of the push block contacts inclined surface of the water stop valve and thus pushes the inclined surface of the water stop valve, and thus the water stop valve moves in the direction away from the washer, and a gap is thus formed between the circular conic convex surface of the water stop valve and the circular conic concave surface of the washer, and a passage is thus formed between the water inlet and water outlet mechanism and the sprinkler mechanism; when the button is released, under the elastic force of the spring and water pressure, the inclined surface of the water stop valve pushes the inclined surface of the push block, and the push block moves in the spring releasing direction; when the button resets, the water stop valve tightly presses the washer; when the switch is in the turned-off state, the teeth of the switch and the teeth of the button are in an engaged state, and the teeth of the switch unidirectionally lock the teeth of the button.

In one preferred embodiment, the sprinkler mechanism comprises a sprinkler, a change-over switch, a sprinkler water outlet nozzle, and a sprinkler water outlet connecting part connected with a sprinkler water inlet connecting part, the sprinkler water inlet connecting part is communicated with the water inlet and outlet mechanism, the sprinkler, change-over switch and the sprinkler water outlet nozzle are connected as a whole which are rotatable around the axis thereof; a plurality of spray orifices distributed in a circular way are provided on the sprinkler; the sprinkler water outlet nozzle has a plurality of first holes, a plurality of second holes and a central hole, and the first holes are communicated with the central hole; the second holes are communicated with the spray orifices of the sprinkler; a hole is provided at one end of the sprinkler water outlet connecting part; in the rotating process of the change-over switch, the change-over switch makes the hole of the sprinkler water outlet connecting part selectively connected to the first or second orifices on the water outlet nozzle of the sprinkler.

In rotating process, the change-over switch makes the hole in the water outlet connecting part of the sprinkler selectively connected to the first or second orifices in the water outlet nozzle of the sprinkler. In this way, the spray mode of the sprinkler can be selected. It can be cylindrical direct spray or flower type spray. When watering flowers and plants in a short distance, flower type spray will not injure the flowers or plants.

The purposes, characteristics and effective results of the present invention will be described in detail later with preferred embodiments and drawings.

DETAILED DESCRIPTION OF THE PREFERRED EMBODIMENT

Figure 3:
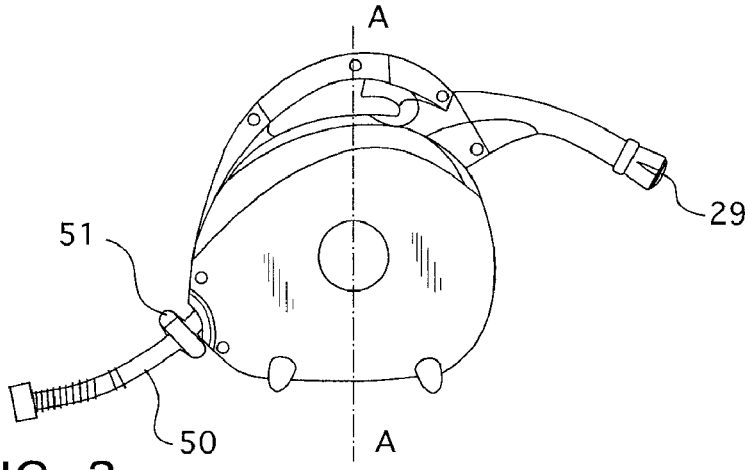
FIG. 3 is a front view of the mobile hose winding apparatus.

As shown in FIG. 3, the mobile hose winding apparatus of the present disclosure is a hose winding apparatus using the resilience of a winding spring as the power for recoiling hose 50. In order to prevent the hose 50 from being all winded up in the case during winding, the head of the hose 50 is provided with the retainer 51. The hose winding apparatus generally consists of a case, a hose winding mechanism, a hose arrangement mechanism, a water inlet and outlet mechanism, a manual locking mechanism, a water inlet and outlet control mechanism or trigger mechanism and a sprinkler mechanism. Those component parts will be respectively described in detail below.

Figure 16:
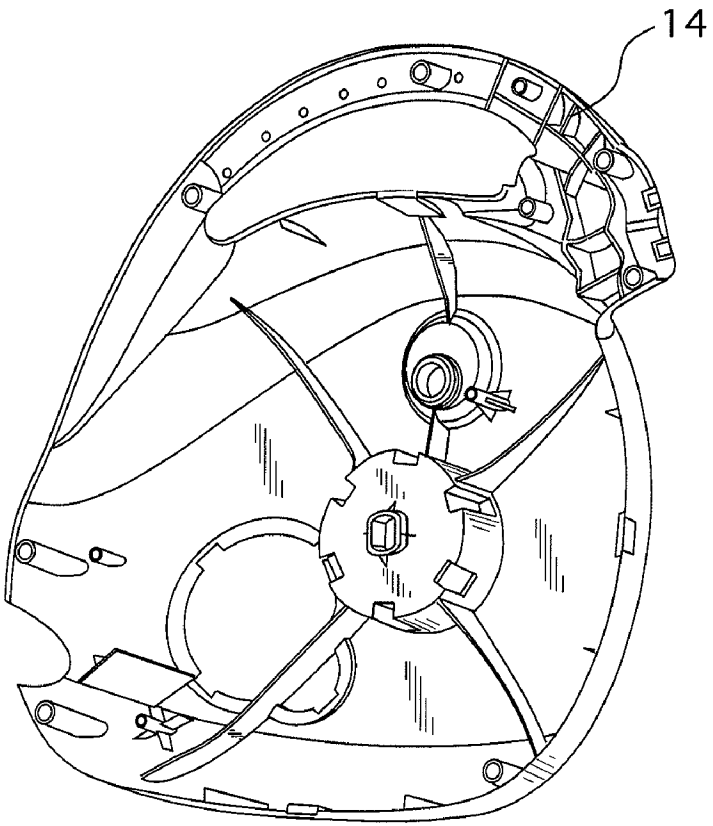
FIG. 16 is an isometric view of a right case.
Figure 15:
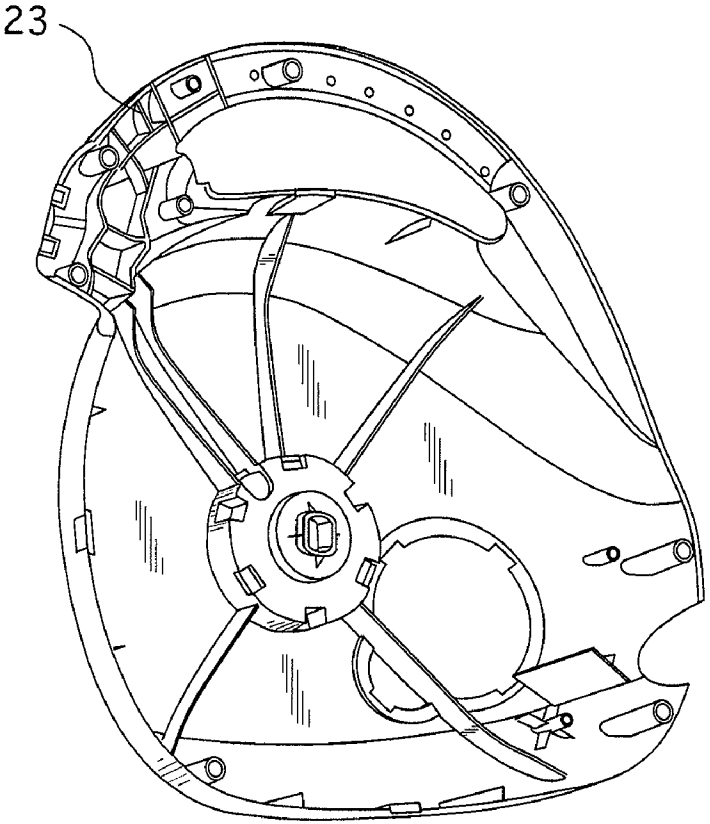
FIG. 15 is an isometric view of a left case.

As shown in FIGS. 15 and 16, the case consists of a left case 52 and a right case 53. Most of the other components of the mobile hose winding apparatus of the present disclosure are contained in a space defined by the left case 52 and right case 53.

Figure 4:
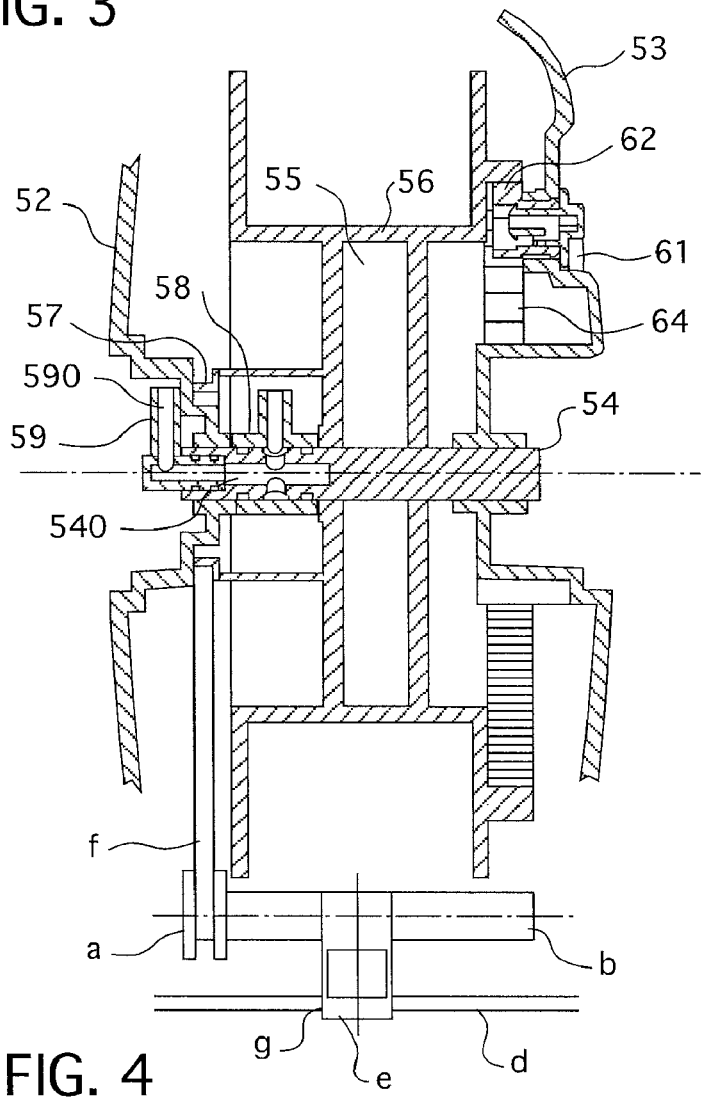
FIG. 4 is a sectional view of the mobile winding apparatus along axle A-A in FIG. 3.

As shown in FIG. 4, the hose winding mechanism includes a main axle 54 of a winding wheel 56 fixed on the left case 52 and right case 53, a winding spring 55 and winding wheel 56 installed on and being rotatable around the main axle 54. A fixing slot (not illustrated in figure) is provided in the main axle 54 of the winding wheel 56. One end of the winding spring 55 is fixed on the internal wall of he winding wheel 56, and the other end of the winding spring 55 is fixed on the main axle 54 of the winding wheel via the fixing slot. The winding spring 55 provides resilience to automatically recoil the hose which is pulled out.

Figure 17:
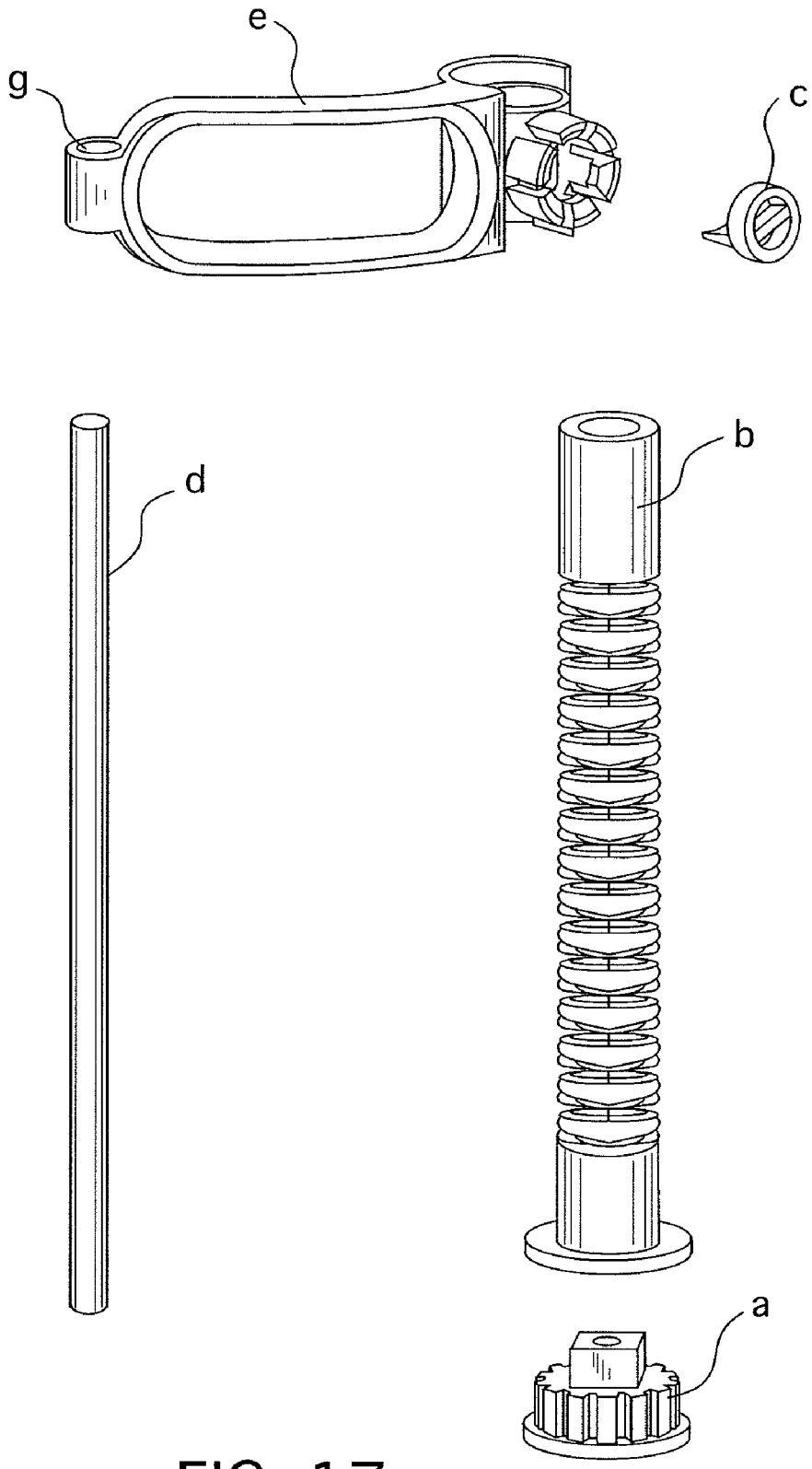
FIG. 17 is an exploded view of a hose arrangement mechanism.

Referring to FIG. 4 again, and also referring to FIG. 17, the hose arrangement mechanism is installed on the case, and the hose arrangement mechanism consists of the synchronous gear 57, guidepost d, pinion a, bidirectional trapezoidal screw b, reversing block c, erecting frame e and synchronous toothed belt f. The synchronous gear 57 is coaxially fixed on the left side of the winding wheel 56. The synchronous gear 57 and the pinion a are connected with each other via the synchronous toothed belt f. The pinion a is fitted on one side of the bidirectional trapezoidal screw b. The erecting frame e is installed on the bidirectional trapezoidal screw b. The reversing block c is installed on the erecting frame e with a thin piece which is located on the thread of the screw b. The guidepost d is configured on the left case 52 and right case 53; the circular hole g in the erecting frame e cooperates with the guidepost d. The function of the hose arrangement mechanism is to arrange the hose in a good order during winding. When the hose is pulled out, the winding wheel 56 drives the synchronous gear 57 to rotate together. And the synchronous gear 57 drives the pinion a to rotate together via the synchronous toothed belt f so as to make the bidirectional trapezoidal screw b rotate. In this way, the purpose of the hose arrangement is achieved. When one layer is arranged well, under the force of the reversing block, the erecting frame e automatically changes direction of move to arrange the next layer of these hose.

Figure 1:
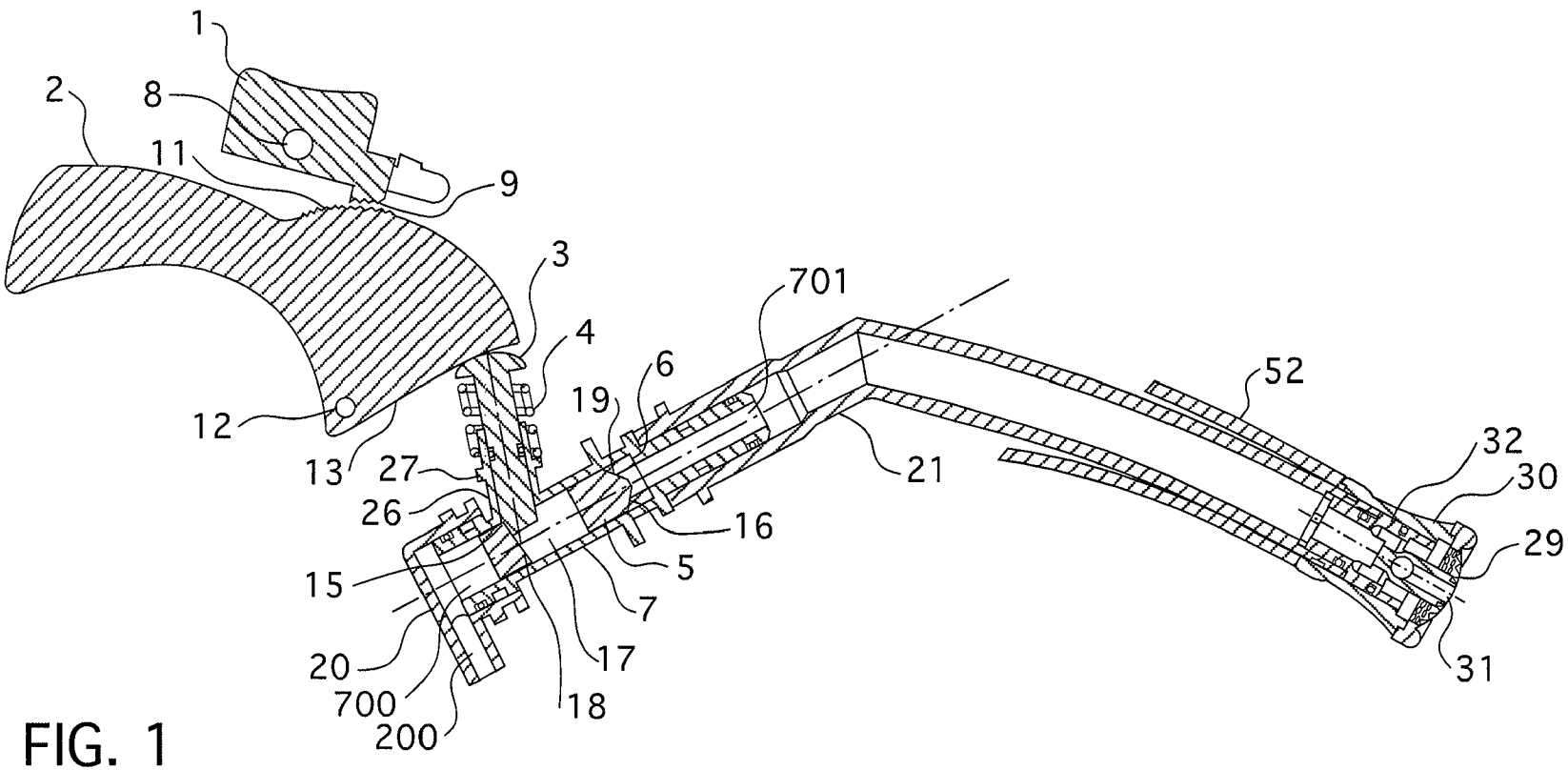
FIG. 1 is a sectional view of the water inlet and outlet control mechanism or a trigger mechanism and the sprinkler mechanism. In the figure, the water inlet and outlet control mechanism is turned off and the sprinkler is in the flower type spray position.
Figure 2:
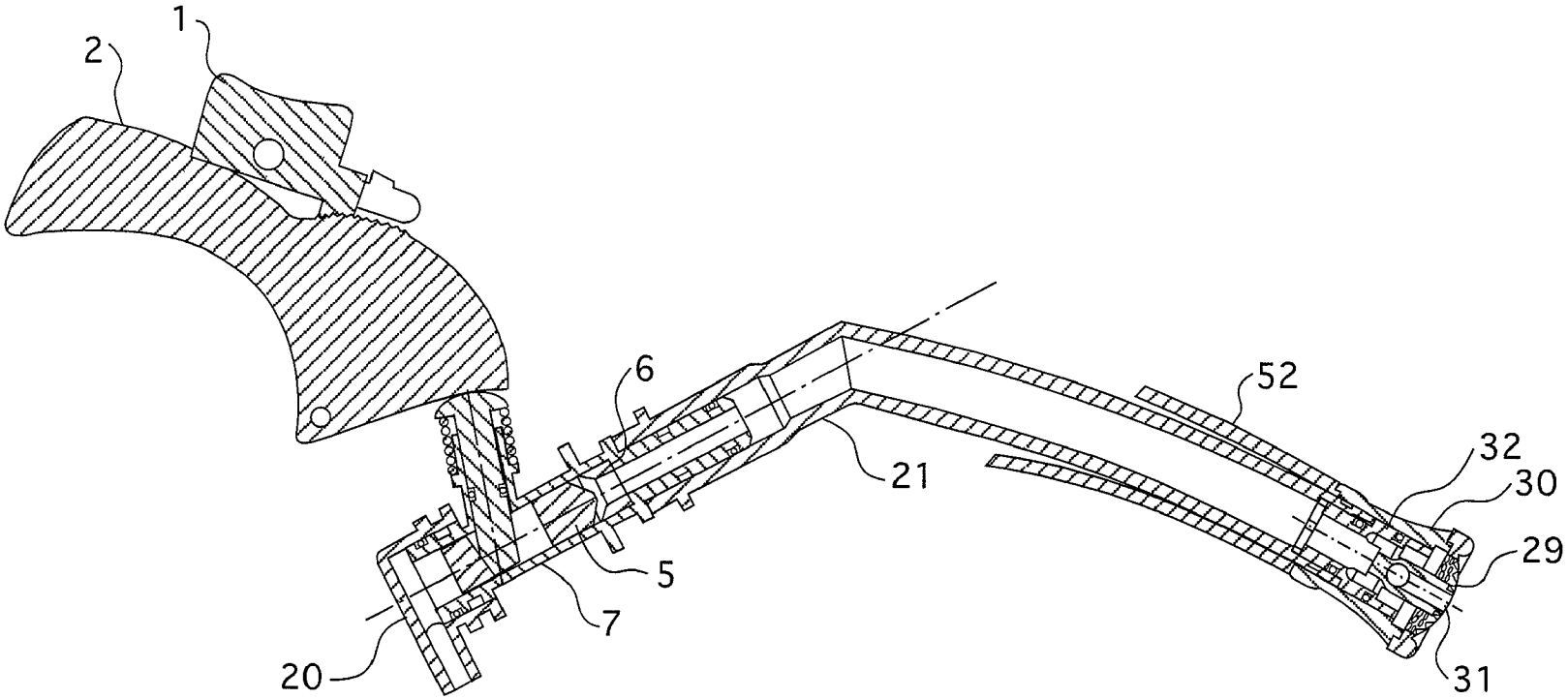
FIG. 2 is a sectional view of the water inlet and outlet control mechanism or a trigger mechanism and the sprinkler mechanism. In the figure, the water inlet and outlet control mechanism is turned off and the sprinkler is in the cylindrical spray position.

Continuing to refer to FIG. 4, the water inlet and outlet mechanism generally includes a water inlet hose 50, a water inlet connecting part 58, the main axle 54 of the winding wheel, a water outlet connecting part 59, a water outlet pipe (not illustrated in the figure), and as shown in FIGS. 1 and 2, a sprinkler water inlet connecting part 20, a sprinkler water inlet connecting part 7, a sprinkler water inlet connecting part 21, a sprinkler water outlet connecting part 32 and a water sprinkler outlet nozzle 31.

The main axle 54 of the winding wheel is configured with an axial water outlet 540 and fixed with the water outlet connecting part 59. Water inlet connecting part 58 is laterally configured with a water inlet 580 and connected with the water inlet hose winded upon the winding wheel 56. A water outlet 540 of the main axle 54 of the winding wheel communicate with the water inlet 580 of the water inlet connecting part 58. Annular slots is provided at the connection part between the main axle 54 of the winding wheel and the water inlet connecting part 58. And sealing rings are embedded in the slots to ensure that the water inlet connecting part 58 is able to rotate freely around the main axle 54 of the winding wheel without leakage. The water inlet connecting part 58 are freely rotatable around axis thereof and without axial looseness. Annular slots are configured at the connection between the water outlet connecting part 59 and the main axle 54 of the winding wheel. And sealing rings are embedded in the slots to ensure it properly sealed without leakage. The water outlet connecting part 59 is fixedly connected with the main axle 54 of the winding wheel. A water outlet 590 of the water outlet connecting part 59 is fixedly connected with a water outlet pipe (not illustrated in figures). As shown in FIG. 1, the sprinkler water inlet connecting part 20 is laterally configured with a water inlet 200 which would be fixedly connected with the other end of the water outlet pipe which connects with the part 59. The sprinkler water connecting part 7 is fixedly connected to the case.

As shown in FIG. 1, the sprinkler water inlet connecting part 7 is configured with an axial water inlet 700 and a water outlet 701. The end of the water inlet 700 of the sprinkle water inlet connecting part 7 is fixedly connected with the sprinkle water inlet connecting part 20. The end of the water outlet 701 of the sprinkle water inlet connecting part 7 is fixedly connected with the sprinkle water inlet connecting part 21. Annular slots are configured at the connection between the sprinkle water inlet connecting part 7 and the sprinkle water inlet connecting part (21 as shown). Sealing rings are embedded in the slot to ensure no leakage at the seal between the sprinkle water inlet connecting part 7 and the sprinkle water inlet connecting part 20. The sprinkler water inlet connecting part 21 is connected with the sprinkler water outlet connecting part 32. And annular slots are configured at the connection between the sprinkle water inlet connecting part 32 and the sprinkle water inlet connecting part 21. Sealing rings are embedded in those slots to ensure no leakage at the seal between the sprinkle water inlet connecting part 32 and the sprinkle water inlet connecting part 21.

Figure 12:
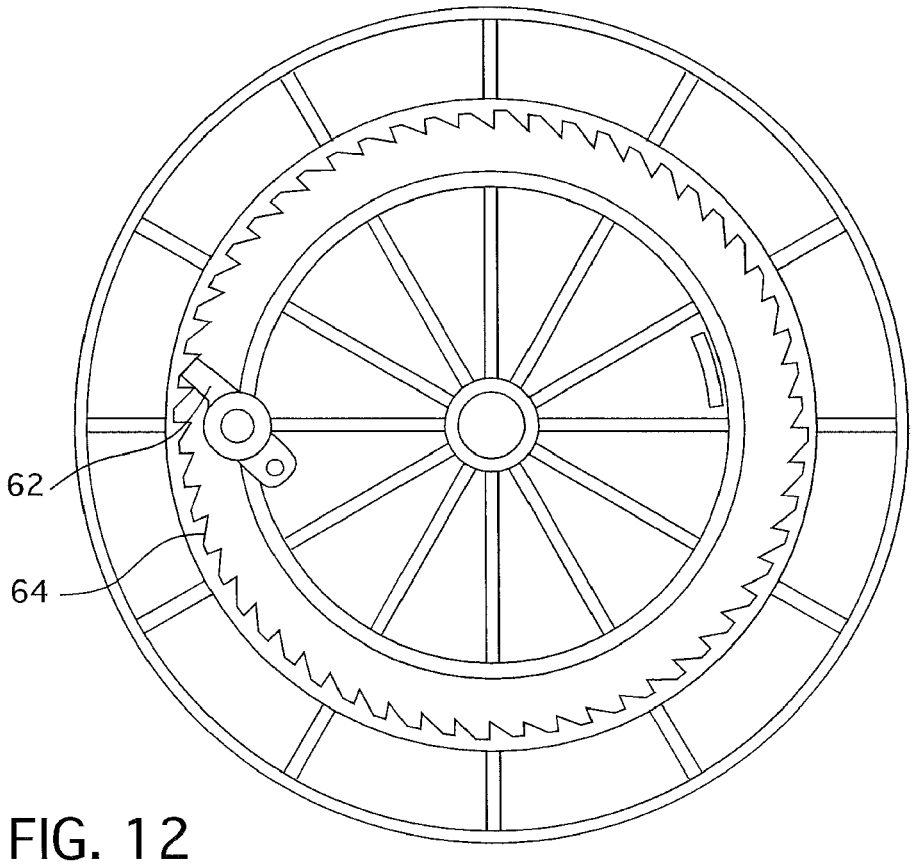
FIG. 12 is a front view of a manual lock in a locked state.
Figure 13:
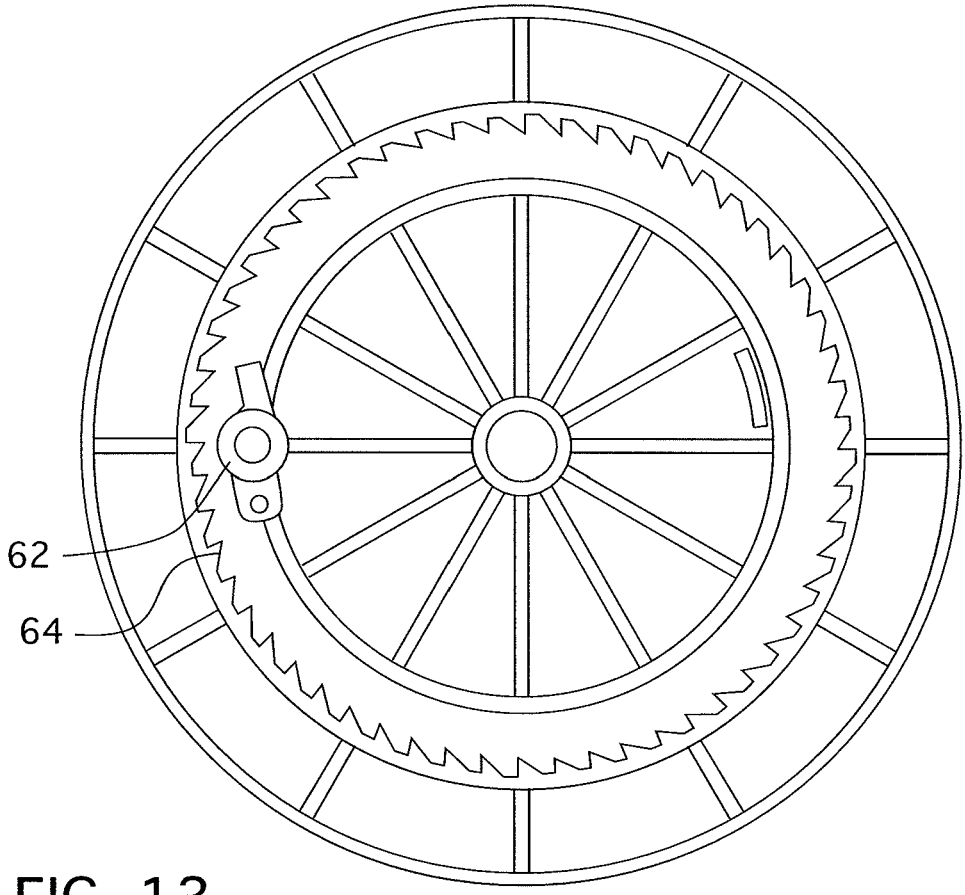
FIG. 13 is a front view of the manual lock in an unlocked state.

As shown in FIGS. 4, 12 and 13, in order to facilitate the coiling and recoiling of the hose, a manual locking mechanism is fitted on the side of the right case 53 adjacent to the hose winding wheel 56. The manual locking mechanism generally includes a manual locking knob 61, a locking block 62 and a locking spring (not illustrated in figures). The manual locking knob 61 is fitted on the right case 53 and can rotate around the axis thereof within a certain range. The locking block 62 is connected with the manual locking knob 61. The locking spring is a torsion spring with one end connected with the locking block 62 and the other end connected with the right case 53. A toothed locking plate 64 is fitted on one side of the winding wheel 56 close to the right case 53. The toothed locking plate 64 has saw-teeth uniformly distributed along the whole circumference. A pointed end of the locking block 62 is corresponding to the saw-teeth of the toothed locking plate 64. When the manual locking knob 61 is in the unlocked state, the pointed end of the locking block 62 is far away from the teeth of the toothed locking plate 64. The hose may be freely pulled out or recoiled. However, when the manual locking knob 61 is moved to a locked position, under the force of the locking spring, the pointed end of locking block 62 (as shown) moves toward the toothed locking plate and is engaged with the saw-teeth on the toothed locking plate 64, and thus the locking block 62 and toothed locking plate 64 constitute a ratchet wheel mechanism. In this way, the hose winding wheel 56 can only rotate in one direction. And the hose is in the locked state and can be pulled out but not recoiled in order to ensure safety.

As shown in FIGS. 1 and 2, in order to control the water discharge volume, a water inlet and outlet control mechanism is fitted at the location close to the handle of the case. The control mechanism generally consists of a switch 1, a button 2, a push block 3, a spring 4, a water stop valve 5 and a sealing washer 6. The switch 1 can rotate within a certain range around a pivot 8 fixed on the case and parallel to the main axle 54 of the winding wheel 54. A saw-tooth 9 is configured on the switch 1.

Figure 14:
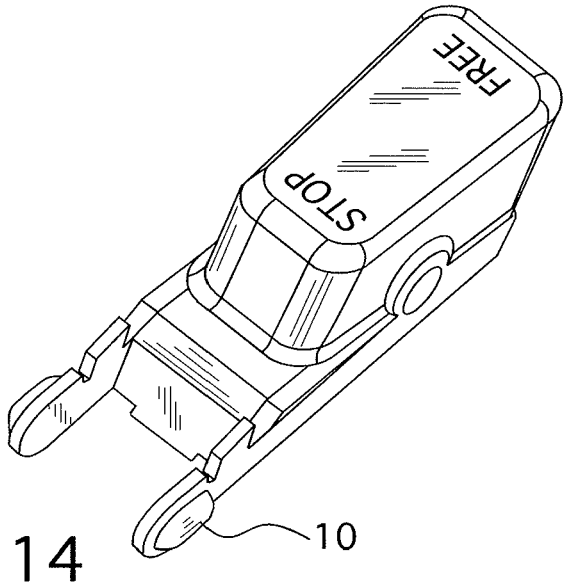
FIG. 14 is an isometric view of a switch.

Referring FIG. 14 at the same time, two elastic pieces 10 are fitted in the front of the switch 1. Additionally, referring FIGS. 15 and 16, a boss 23 is provided on the left case 52. A boss 14 is provided on the right case 53. The function of the boss 23 and boss 14 is to cooperate with the elastic pieces 10 on the switch 1. When the switch is turned on, the elastic pieces 10 are above the bosses 23 and 14. When the switch 1 is turned off, the elastic pieces 10 are below the bosses 23 and 14. A the saw-teeth 11 corresponding to the saw-teeth 9 on the switch 1 are provided on the button 2, and distributed along a section of a circular arc with the pivot 12 as the center of circle. An inclined surface 13 is provided on the button 2 close to the push block 3. The button 2 can rotate within a certain range around the pivot 12 fixed on the case and parallel to the main axle 54 of the winding wheel. A cylindrical boss 26 is provided on the side of the sprinkler water inlet connecting part 7 as shown, forming a certain angle with the axis thereof. A shaf shoulder 27 is provided on the cylindrical boss 26 as shown. A hemispherical head is provided on one end of the push block 3 which is adjacent to the inclined surface 13 of the button 2. An annular slot or slots is or are provided at the connection between the push block 3 and the central hole of the cylindrical boss 26. A sealing ring or rings is or are embedded in the slot or slots to ensure when the push block 3 moves, no leakage will be happened at the sealing of the axial hole. The water stop valve 5 and washer 6 as shown are located in the central hole of the sprinkler water inlet connecting part 7. An inclined surface 15 is provided at the position on the push block 3 close to the water stop valve 5. An opening 17 is configured on the water stop valve 5. An inclined surface 18 cooperated with the inclined surface 15 is configured on one side of the opening 17. And the circular conic surface 16 is configured on the side of the water stop valve 5 close to washer 6. One end of the washer 6 is a plane and the other end is configured with a circular conic concave surface 19 cooperated with the circular conic convex surface 16 of the water stop valve 5. One end of the spring 4 is set on the push block 3. The position of the spring 4 is limited by the plane end of the hemispherical head of the push block 3. And the other end of the spring is set on the cylindrical boss 26 of the sprinkler water inlet connecting part 7. The position of the spring 4 is limited by the step 27.

When the switch 1 is in the position shown in FIG. 1, it is turned on. And the tooth 9 is out of the circular arc of the tooth 11. The button 2 can rotate freely within a certain range around the pivot 12. When the button 2 is pressed, it rotates clockwise around the pivot 12. Correspondingly, the inclined surface 13 of the button 2 pushes the hemispherical part of the push block 3. And the push block 3 overcomes the elastic force of the spring 4 and moves in the compression direction of the spring 4. The inclined surface 15 of the push block 3 pushes the inclined surface 18 of the water stop valve 5. The water stop valve 5 moves in the direction away from the washer 6. A gap is formed between the circular conic convex surface 16 of the water stop valve 5 and the circular conic concave surface 19 of the washer 6. And thus a passage is formed in the water inlet and outlet mechanism. The greater the compression of the button 2 is, the greater the gap between the circular conic convex surface 16 of the water stop valve 5 and the circular conic concave surface 19 of the washer 6 will be. And the water flow rate will correspondingly become greater. When the button 2 is released, under the elastic force of the spring 4 and water pressure, the inclined surface 18 of the water stop valve 5 pushes the inclined surface 15 of the push block 3. The push block 3 thus moves in the spring releasing direction so as to push the button 2 toward the reset direction. When the button 2 is completely reset, the water stop valve 5 tightly compresses the washer 6 and the water outlet is closed.

When the switch 1 is turned clockwise to a turned-off position as shown in FIG. 2, the tooth 9 and tooth 11 are engaged. When the button 2 is pressed, the tooth 11 of the button 2 and the tooth 9 of the switch 1 are engaged. And the tooth 11 and tooth 9 form a single direction ratchet wheel actuator. When the button 2 stops at a position, the button 2 is locked because of the engagement of the tooth 11 and tooth 9; continue to press the button 2, the tooth 11 of the button 2 slides over the tooth 9 of the switch 1. When the movement is stopped, the button 2 is locked because of the engagement of the tooth 11 and tooth 9. When unlocking is required, turn the switch 1 counterclockwise for one angle to the turned-on position. The locking of the tooth 11 of the button 2 is released. The button 2 springs counterclockwise to the initial position.

Figure 5:
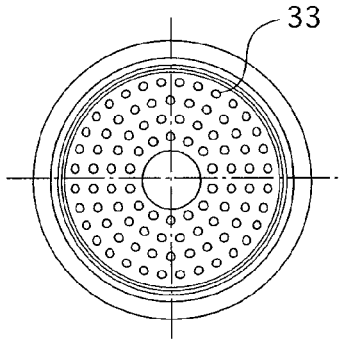
FIG. 5 is a front view of a sprinkler.
Figure 6:
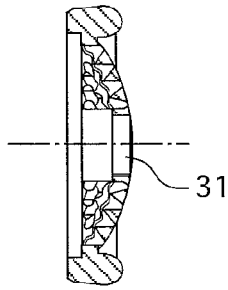
FIG. 6 is a sectional view of a sprinkler.
Figure 7:
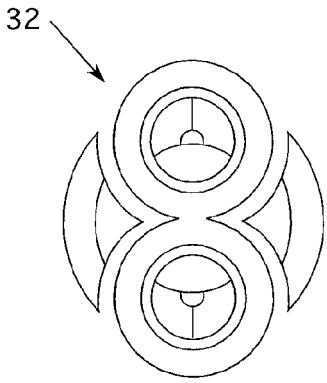
FIG. 7 is a front view of a water outlet connecting part 32 of a sprinkler.
Figure 8:
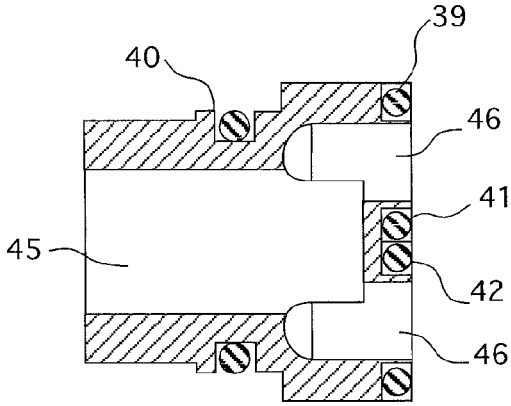
FIG. 8 is a sectional view of the water outlet connecting part 32 of the sprinkler.
Figure 9:
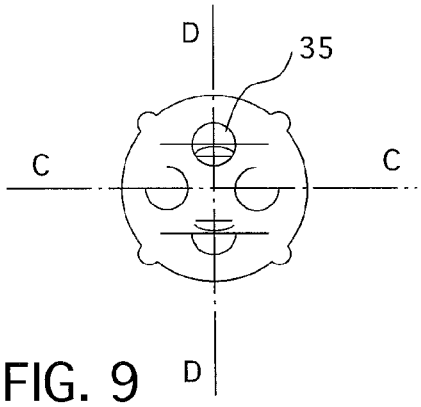
FIG. 9 is a front view of a water outlet nozzle 31 of a sprinkler.
Figure 10:
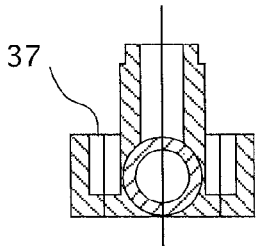
FIG. 10 is a sectional view of the water outlet nozzle 31 of the sprinkler along C-C line in FIG. 9.
Figure 11:
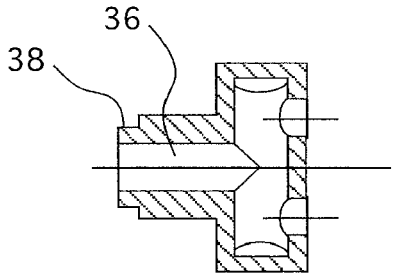
FIG. 11 is a sectional view of the water outlet nozzle 31 of the sprinkler along D-D line in FIG. 9.

As shown in FIG. 1, the sprinkler mechanism is fitted in the front of the hose winding apparatus. The sprinkler mechanism generally consists of the sprinkler 29, change-over switch 30, sprinkler water outlet nozzle 31 and sprinkler water outlet connecting part 32. The sprinkler 29, change-over switch 30 and water sprinkler outlet nozzle 31 are integrated with glue or ultrasonic welding so as to rate integratedly within a certain range around axis thereof. As shown in FIG. 5, several all-through holes 33 distributed according to the circumference are provided on the sprinkler 29. As shown in FIGS. 9, 10 and 11, four holes are distributed symmetrically on the water outlet nozzle 31 of the sprinkler. Two of the corresponding holes 35 are connected or communicated with the central holes 36 of the cylinder 38 on the sprinkler water outlet 31, forming a passage. And other two corresponding holes 35 are connected with two all-through holes 37 located on the external side of the cylinder 38, forming another passage to realize function of conversion. As shown in FIGS. 7 and 8, two annular grooves 39 and 40 are configured on the end of the sprinkler water outlet connecting part 32 and respectively used for installing sealing rings 41 and 42. Two symmetrically distributed holes 46 are configured on the internal side of the annular grooves 39 and 40. And the holes 46 are connected with the axial hole 45 of the sprinkler water outlet connecting part 32. The circle center of holes 46 is on the same circular arc with the circle centers of the hole 35 and hole 37. There are two spray states of the sprinkler; one is the cylindrical direct spray and the other is flower type spray. When turning the change-over switch 30 to make the two holes 35 in the sprinkler water outlet nozzle 31 correspond to the two holes 46 in the sprinkler water outlet connecting part 32, the sprayed water is in a cylindrical state. When turning the change-over switch 30 to make the two holes 37 in the sprinkler water outlet nozzle 31 correspond to the two holes 46 in the sprinkler water outlet connecting part 32. The sprayed water is in the flower type spray state.

What is claimed is:

1. A mobile hose winding apparatus comprising:

a case;

a hose winding mechanism for hose winding;

a sprinkler mechanism;

a water inlet and outlet mechanism, with one end connected to a hose on the hose winding mechanism and another end connected to the sprinkler mechanism;

wherein, the hose winding mechanism and the water inlet and outlet mechanism are fitted in the case, the sprinkler mechanism is fitted in the front of the case;

wherein the sprinkler mechanism comprises a sprinkler, a change-over switch, a sprinkler water outlet nozzle, and a sprinkler water outlet connecting part connected with a sprinkler water inlet connecting part, the sprinkler water inlet connecting part is communicated with the water inlet and outlet mechanism, the sprinkler, change-over switch and the sprinkler water outlet nozzle are connected as a whole; a plurality of spray orifices distributed in a circular way are provided on the sprinkler; the sprinkler water outlet nozzle has a plurality of first holes, a plurality of second holes and a central hole, and the first holes are communicated with the central hole; the second holes are communicated with the spray orifices of the sprinkler, a hole is provided at one end of the sprinkler water outlet connecting part; and the change-over switch makes the hole of the sprinkler water outlet connecting part selectively connected to the plurality of spray orifices of the sprinkler or the central hole on the water outlet nozzle.

2. A mobile hose winding apparatus comprising:

a case;

a hose winding mechanism for hose winding;

a sprinkler mechanism;

a water inlet and outlet mechanism, with one end connected to a hose on the hose winding mechanism and another end connected to the sprinkler mechanism;

wherein, the hose winding mechanism and the water inlet and outlet mechanism are fitted in the case, the sprinkler mechanism is fitted in the front of the case;

a water inlet and outlet control mechanism for controlling the flow rate through the water inlet and outlet mechanism, the water inlet and water outlet control mechanism being fitted in the case;

wherein the water inlet and water outlet mechanism and the sprinkler mechanism are connected with each other via sprinkler water inlet connecting parts or part; the sprinkler water inlet connecting part having a central hole; the water inlet and water outlet control mechanism comprises a switch, a button, an actuator and a water stop valve; the water stop valve is located in the central hole of the sprinkler water inlet connecting part for regulating the flow rate between the water inlet and water outlet mechanism and the sprinkler mechanism; the actuator is fitted between the button and the water stop valve for transmitting the motion of the button to the water stop valve; when the switch is in the turned-on state, the button can operate freely and move the water stop valve in the central hole of the sprinkler water inlet connecting part via the actuator to control the flow rate between the water inlet and water outlet mechanism and the sprinkler mechanism; when the switch is in the turned-off state, the button is locked by the switch.

3. The mobile hose winding apparatus in claim 2, wherein the actuator of the water inlet and water outlet control mechanism comprises a push block having a head; the switch can rotate around a pivot fixed on the case; the switch has saw-teeth; the button can rotate around a pivot fixed on the case; the button has saw-teeth corresponding to the teeth on the switch, with the saw-teeth distributed along a section of circular arc with the pivot of the button as the center of a circle, one side of the button close to the head of the push block is configured with an inclined surface, a side of the sprinkler water inlet connecting part is configured with a columnar boss for the push block to insert into, with a spring fitted between the columnar boss and the push block; a washer is also fitted in the central hole of the sprinkler water inlet connecting part; the end of the push block close to the water stop valve is configured with an inclined surface, and the water stop valve is configured with an opening; the side of the water stop valve with the opening is configured with an inclined surface cooperated with the inclined surface of the push block; the side of water stop valve close to the washer is configured with a circular conic convex surface, and the washer has a circular conic concave surface cooperated with the circular conic convex surface of the water stop valve; when the switch is in the turned-on state, the teeth of the switch are located outside the circular arc of the button, and the button can rotate freely around the pivot thereof; when the button is pushed, the inclined surface of the button contacts the push block and pushes the head of the push block, and the push block overcomes the elastic force of the spring and moves in the spring compression direction, then the inclined surface of the push block contacts the inclined surface of the water stop valve and thus pushes the inclined surface of the water stop valve, and thus the water stop valve moves in the direction away from the washer, and a gap is thus formed between the circular conic convex surface of the water stop valve and the circular conic concave surface of the washer, and a passage is thus formed between the water inlet and water outlet mechanism and the sprinkler mechanism; when the button is released, under the elastic force of the spring and water pressure, the inclined surface of the water stop valve pushes the inclined surface of the push block, and the push block moves in the spring releasing direction; when the button resets, the water stop valve tightly presses the washer; when the switch is in the turned-off state, the teeth of the switch and the teeth of the button are in an engaged state, and the teeth of the switch unidirectionally lock the teeth of the button.

4. A mobile hose winding apparatus comprising:

a case;

a hose winding mechanism for hose winding;

a sprinkler mechanism;

a water inlet and outlet mechanism, with one end connected to a hose on the hose winding mechanism and another end connected to the sprinkler mechanism;

wherein, the hose winding mechanism and the water inlet and outlet mechanism are fitted in the case, the sprinkler mechanism is fitted in the front of the case;

wherein a manual locking mechanism is fitted between the case and one side of the hose winding mechanism adjacent to the case, the manual locking mechanism comprising a manual locking knob, a locking block and a locking spring; the manual locking knob is fitted on the external side of the case and can rotate thereon; the locking block and the manual locking knob are fixedly connected with each other, the locking spring is a torsion spring, with one end of the spring connected to the locking block and the other end to the case, a toothed locking plate is fitted on the side of the winding mechanism, with saw-teeth uniformly distributed along a circumference on the toothed locking plate; a pointed end of the locking block can mesh with the saw-teeth of the toothed locking plate to form a one-way locking device; when the locking knob is in a turned-on state, the pointed end of the locking block is far away from the toothed locking plate, and thus the hose can be freely pulled out from, or recoil back into the hose winding mechanism; when the manual locking button is in a locking position, under the force of the locking spring, the pointed end of the locking block is engaged with the saw-teeth of the toothed locking plate, at this time, a hose winding wheel of the hose winding mechanism is only able to rotate in one direction, so the hose is locked, and the hose can be pulled out but cannot recoil.

5. A mobile hose winding apparatus comprising:

a case;

a hose winding mechanism for hose winding;

a sprinkler mechanism;

a water inlet and outlet mechanism, with one end connected to a hose on the hose winding mechanism and another end connected to the sprinkler mechanism;

wherein, the hose winding mechanism and the water inlet and outlet mechanism are fitted in the case, the sprinkler mechanism is fitted in the front of the case;

wherein the hose winding mechanism comprises a main axle of a winding wheel fixed on the case, a winding spring and the winding wheel which is rotatably fitted on the main axle, one end of the winding spring is fixed on the winding wheel, and the other end of the winding spring is fixed on the main axle of the winding wheel; the winding spring provides resilience to automatically recoil back any hose that is pulled out.

6. The mobile hose winding apparatus in claim 5, wherein the water inlet and outlet mechanism comprises a water inlet connecting part and a water outlet connecting part, a water outlet is fitted in the main axle of the winding wheel along axial direction thereof and connected with the water outlet connecting part; the water inlet connecting part is sleeved on the main axle of the winding wheel; a water inlet is provided in one side of the water inlet connecting part, the water inlet is used to fixedly connect a hose wound on the winding wheel; a water inlet of the main axle of the winding wheel is communicated with the water inlet of the water inlet connecting part; the connection between the main axle of the winding wheel and the water inlet connecting part is sealed with a sealing element or elements; the water inlet connecting part can rotate freely around the main axle of the winding wheel but cannot move in the axial direction; the connection between the water outlet connecting part and the main axle of the winding wheel is sealed with the sealing element, and the water outlet of the water outlet connecting part is used to communicated with the sprinkler mechanism.

* * * * *

UNITED STATES PATENT AND TRADEMARK OFFICE

CERTIFICATE OF CORRECTION

PATENT NO. : 8,267,330 B2
APPLICATION NO. : 12/732269
DATED : September 18, 2012
INVENTOR(S) : Jian Huang It is certified that error appears in the above-identified patent and that said Letters Patent is hereby corrected as shown below:

Column 1, line 57, "used, up," should read --used up,--.
Column 2, line 53, "connect" should read --connected--.
Column 2, line 59, "an one-way" should read --a one-way--.
Column 3, line 12, "winded on" should read --wound on--.
Column 3, line 22, "to communicated" should read --to communicate--.
Column 3, line 34, "ad the" should read --and the--.
Column 3, line 58, "opening,The side" should read --opening. The side--.
Column 5, line 50, "of he winding" should read --of the winding--.
Column 6, line 12, "of move" should read --of movement--.
Column 6, line 13, "these hose" should read --the hose--.
Column 6, lines 28-29, "communicate" should read --communicates--.
Column 6, line 52, "sprinkle" should read --sprinkler--.
Column 6, line 53, "sprinkle" should read --sprinkler--.
Column 6, line 55, "sprinkle" should read --sprinkler--.
Column 6, line 56, "sprinkle" should read --sprinkler--.
Column 6, line 57, "sprinkle" should read --sprinkler--.
Column 6, line 58, "sprinkle" should read --sprinkler--.
Column 6, line 61, "sprinkle" should read --sprinkler--.
Column 6, line 65, "sprinkle" should read --sprinkler--.
Column 6, line 66, "sprinkle" should read --sprinkler--.
Column 7, line 1, "sprinkle" should read --sprinkler--.
Column 7, line 2, "sprinkle" should read --sprinkler--.
Column 7, line 39, "winding wheel 54" should read --winding wheel 56--.
Column 7, line 41, "Referring" should read --Referring to--.
Column 7, line 42, "referring" should read --referring to--.
Column 7, line 49, "A the" should read --The--.
Column 7, line 65, "happened" should read --happening--.
Column 11, line 32, "into the" should read --into, the--.
Column 12, line 37, "communicated" should read --communicate--.

Signed and Sealed this
Nineteenth Day of February, 2013

Teresa Stanek Rea
*Acting Director of the United States Patent and Trademark Office*